United States Patent [19]

Gage et al.

[11] Patent Number: 4,497,567

[45] Date of Patent: Feb. 5, 1985

[54] TONER TRANSFERRING METHOD AND APPARATUS

[75] Inventors: Charles A. Gage, Webster; Timothy T. Blair, Shortsville; Thomas W. Morgan, Macedon, all of N.Y.

[73] Assignee: Xerox Corporation, Stamford, Conn.

[21] Appl. No.: 489,621

[22] Filed: Apr. 28, 1983

[51] Int. Cl.[3] ..... G03G 15/16

[52] U.S. Cl. ..... 355/3 TR; 355/16; 355/77; 430/126

[58] Field of Search ..... 355/3 TR, 3 R, 16, 77, 355/14 TR; 430/126

[56] References Cited

U.S. PATENT DOCUMENTS

| | | | |
|---|---|---|---|
| 2,807,233 | 9/1957 | Fitch | 118/637 |
| 2,836,725 | 5/1958 | Vyverberg | 250/49.5 |
| 3,520,604 | 7/1970 | Shelfo | 355/16 |
| 3,707,138 | 12/1972 | Cartwright | 430/54 X |
| 3,879,121 | 4/1975 | Simpson | 355/3 R |
| 3,920,325 | 11/1975 | Swift | 355/3 R |
| 3,924,943 | 12/1975 | Fletcher | 355/3 R |
| 3,959,573 | 5/1976 | Eddy et al. | 428/425 |
| 4,014,605 | 3/1977 | Fletcher | 355/3 R |
| 4,014,606 | 3/1977 | Seanor et al. | 355/3 R |
| 4,063,808 | 12/1977 | Simpson | 355/3 TR |
| 4,141,728 | 2/1979 | Hemphill | 430/126 |

*Primary Examiner*—R. L. Moses

[57] ABSTRACT

Electrostatographic apparatus and method for transferring charged toner present in an image configuration on an insulating layer bearing an electrostatic latent image are illustrated. The technique involves forming a sandwich comprising the insulating layer with a conductive substrate bearing a toner image on its surface, a copy substrate, a dielectric layer, and a conductive electrode together with means for applying a potential to the conductive electrode after the sandwich is formed, the potential being of a magnitude sufficient to create an electric field to transfer toner from the insulating layer to the copy substrate. The apparatus also includes means to discharge the electrostatic latent image on the insulating layer before separation of the sandwich and means to strip the copy substrate from the dielectric layer while the field is applied to provide a toner image on the copy substrate. In a preferred embodiment the conductive electrode comprises a cyclindrical roll having a circumference at least equal to the length of the image on the insulating layer, and the sandwich is formed by wrapping a photoconductive insulating layer bearing a toner image in contact with a copy sheet around the roll with the dielectric layer forming a blocking electrode in between the insulating layer and the conductive electrode. During the wrapping step the translucent back of the photoconductive layer is exposed to discharge the electrostatic latent image on the photoconductive layer and once the sandwich is formed it is unwrapped to separate the copy sheet from the dielectric layer.

27 Claims, 4 Drawing Figures

48
50
C
56
12
14
31
52
B
51
10
44
53
40
20
18
55
A
41
32
24
26
36
34
42
30
28
29
54

TONER TRANSFERRING METHOD AND APPARATUS

CROSS REFERENCE TO RELATED APPLICATIONS

Reference is hereby made to copending application Ser. No. 489,622, entitled ELECTROSTATIC REPRODUCING MACHINE in the names of Charles A. Gage, Timothy T. Blair and Thomas W. Morgan filed concurrently herewith and to Ser. No. 489,620 entitled REPRODUCING APPARATUS WITH SCROLLED IMAGING WEB in the names of Charles A. Gage, Timothy T. Blair and Thomas W. Morgan also filed concurrently herewith and to Ser. No. 489,615, entitled GEOMETRIC DESIGN REPRODUCING APPARATUS in the names of Charles A. Gage, Timothy T. Blair and Thomas W. Morgan also filed concurrently herewith.

BACKGROUND OF THE INVENTION

This invention relates to electrostatographic reproducing apparatus and methods and more particularly to a method and apparatus for transferring toner images from one surface to another.

In the electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. Most development systems employ a developer material which comprises both charged carrier particles and charged toner particles which triboelectrically adhere to the carrier particles. During development, the toner particles are attracted from the carrier particles by the charge pattern of the image areas on the photoconductive insulating area to form a powder image on the photoconductive areas. This image may be subsequently transferred to a support surface such as copy paper to which it may be permanently affixed by heating or the application of pressure. Following transfer of the toner image to the support surface, the photoconductive insulating surface is cleaned of residual toner to prepare it for the next imaging cycle.

In such apparatus it is common to transfer the toner image from the imaging surface to a support surface such as copy paper. Historically, the transfer of toner images to supporting surface such as copy paper is accomplished with electrostatic transfer by either a corotron transfer device or roller electrode biased to transfer potential levels. In corona induced transfer the final support sheet is placed in direct contact with the toner image while the image is supported on the photoconductive surface and the back of the sheet, that is the side of the sheet away from the image is sprayed with a corona discharge having a polarity opposite to that of the toner particles causing the toner to be electrostatically transferred from the photoconductor to the sheet. This system is to a large extent humidity sensitive in that the copy paper which does contain some moisture is sprayed with ions. The moisture in the copy paper makes the paper conductive and charge migrates through the paper thereby distorting the toner image on the paper. This difficulty is compounded by high relative humidity atmospheres since the moisture level of the copy paper is increased.

In bias roll transfer, it is argued that better control of the forces acting on the toner during transfer is had. This type of transfer involves the use of a metal roll with a resistive resilient coating such as that illustrated in U.S. Pat. No. 2,807,233. Because of the resistivity of the coating, the amount of bias that can be applied to the roll is limited to relatively low operating values, since at the higher range the air in and about the transfer zone begins to breakdown, i.e., ionizes causing the image to be degraded during transfer. In addition, in the pre-transfer or pre-nip region before the copy paper contacts the image if the transfer fields are high the image is susceptible to premature transfer across the air gap leading to decreased resolution or fuzzy images. Further, if there is ionization such as mentioned above with regard to the bias roll transfer in the pre-nip air gap from high fields, it may lead to strobing or other image defects, loss of transfer efficiency and a lower latitude of system operating parameters. Yet in the directly adjacent nip region itself, the transfer field should be as large as possible to achieve high transfer efficiency and stable transfer. In the next adjacent post-nip region at the photoconductor copy sheet separation or stripping area, if the transfer fields are too low, hollow characters may be generated. On the other hand, improper ionization in the post-nip region may cause image instability or copy sheet detacking problems. Variations in conditions of copy paper contaminants, etc., can all effect the necessary transfer of parameters. Furthermore, the bias roll material resistivity and paper resistivity can change greatly with humidity. In order to minimize these difficulties various materials have been used in bias roll transfer systems which because of the degree of sophistication of fabricating them are extremely expensive.

PRIOR ART

U.S. Pat. No. 2,836,725—(Vyverberg) is exemplary of electrostatic transfer which is corona induced.

U.S. Pat. No. 2,807,233 (Fitch) describes bias roll transfer with a metal roll connected to a central source to cause an electric field to exist between the transfer roller and a backing plate.

SUMMARY OF THE INVENTION

In accordance with the present invention, apparatus and method for transferring a charged toner image present in image configuration on insulating layer to a copy substrate is provided. In accordance with the principle aspect of the present invention, electrostatographic apparatus comprising means to form an electrostatic latent image on an insulating layer supported by a conductive substrate and from which the developed toner image may be transferred to copy substrate is provided. The transfer apparatus and method comprise forming a sandwich comprising the conductive substrate of the insulating layer the insulating layer bearing the electrostatic latent image, the toner image, a copy substrate, a dielectric layer forming a blocking electrode, and a conductive electrode as well as means for applying a potential to the conductive electrode after the sandwich is formed of a magnitude and potential to create an electric field to transfer the toner from the insulating layer to the copy substrate, and further including means to discharge the electrostatic latent image on the insulating layer before separation of the sandwich, and means to strip the copy substrate from the insulating layer while said field is applied to provide a toner image on said copy substrate.

In a specific aspect of the present invention the sandwich is formed by wrapping the insulating layer with the toner image in contact with a copy substrate around a cyclindrical conductive roll electrode with a dielectric blocking electrode being placed between the copy substrate and the conductive electrode, and the circumference of the roll being at least equal to the length of the image on the insulating layer and the copy substrate.

In a further aspect of the present invention the insulating layer comprises a photoconductive insulating layer on a translucent conductive substrate the charge pattern of which is discharged by exposure to radiation through the translucent conductive substrate during formation of the sandwich.

In an additional aspect of the present invention the sandwich described above is formed with substantially no electric field tending to drive the toner image on the insulating layer to the copy substrate.

In a further aspect of the present invention, the sandwich is formed with only sufficient pressure between the insulating layer and the copy substrate to provide intimate contact therebetween and is at a level below which by itself produces little pressure transfer toner from the insulating layer to the copy paper.

In an additional aspect of the present invention, the blocking electrode prevents air breakdown by maintaining the electric field and not permitting the conduction of electric current from the insulating layer to the conductive electrode.

Accordingly, it is an object of the present invention to provide apparatus and method for electrostatically transferring a toner image from an insulating imaging surface to a copy substrate.

It is a another object of the present invention to provide a highly reliable and efficient method and apparatus for transferring toner from an insulating surface to a copy substrate.

It is an additional object of the present invention to provide method and apparatus for transferring toner from an insulating surface to a copy substrate which is of low cost and relatively insensitive to changes in humidity.

It is a further object of the present invention to provide a simple, readily manufacturable transfer apparatus which does not require either close manufacturing or operational tolerances.

It is a further object of the present invention to provide a transfer apparatus in an electrostatographic machine which does not require the generation of ionization species as well as the need for removal of ionization species.

For a better understanding of the invention as well as other objects and further features thereof, reference is had to the following drawings and descriptions.

BRIEF DESCRIPTIONS OF THE DRAWINGS

Figure 2:
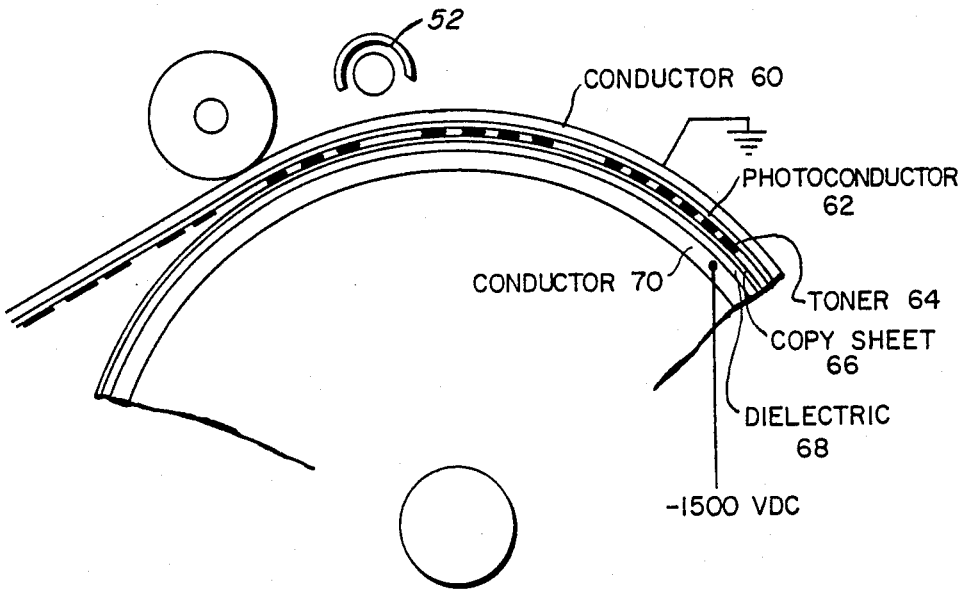
FIG. 2 is a schematic representation in cross-section of the sandwich formed during the transfer of the toner image from the insulating layer to the copy substrate with the apparatus and method according to the present invention.
Figure 3A:
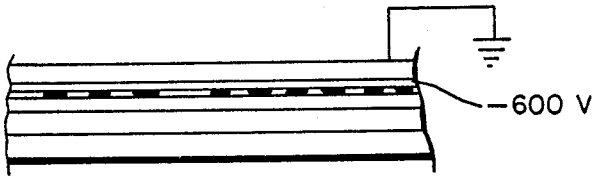
Figure 3B:
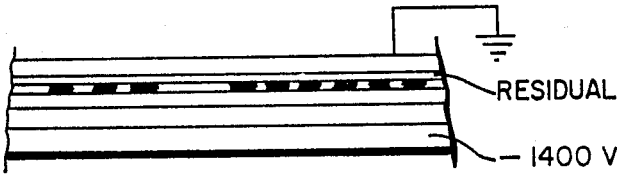

FIGS. 3*a* and 3*b* are greatly enlarged cross-sections of the transfer sandwich of FIG. 2. FIG. 3*a* represents a sandwich formed with the electrostatic latent image present on the photoconductive layer and FIG. 3*b* represents the sandwich after the translucent substrate of the photoconductive layer has been exposed to light and while the potential is applied to the conductive electrode.

DETAILED DESCRIPTION OF THE INVENTION

The invention will now be illustrated with reference to the schematic representation of FIG. 1, wherein a small copy reproducing machine is depicted. The overall concept is based on the use of a two cycle reusable retractable scroll photoreceptor system that is wound or wrapped up in "window shade" fashion during a first series of imaging steps and upwrapped during a second series of imaging steps. The machine concept comprises a flexible reusable strip 10 of photoconductive material on a conductive backing, one end of which is fastened by a strip of insulating leader 12 to take up roll 14, the other end of which is also attached by an insulating leader 18 to a photoconductive supply roll 20. Either the take up roll 14 or the supply roll 20 may be positively driven in both the forward and reverse directions while the other of which is spring biased like a window shade with, for example, a spring 31 to maintain tension on the strip photoconductor during the various process steps. Preferably the supply roll 20 is positively driven by means not shown and the larger take up roll is spring biased to maintain the tension in the strip of photoconductive material. Preferably, while the supply roll may be relatively small in diameter to provide compactness in size, the take up roll is of a size such that its circumference is at least as great as the image area on the photoconductor or the largest size document the apparatus is capable of reproducing. This enables transfer of the developed toner image according to the technique to be hereinafter described.

In making a copy an original document is manually inserted in slot 24 where it is transported past viewing platen 26 by a resilient foam roll 28 driven at constant speed in contact with the viewing platen. The document is viewed on the platen by virtue of lamp 30 in illumination cavity 32 through a lens 36 such as a Selfoc lens to expose the photoconductor 10 at exposure station 34. As the document is transported past the viewing platen, the photoconductor is transported past a charging station such as the illustrated cylindrical brush charging apparatus 41 and the exposure station 34 to form an electrostatic latent image on photoconductor 10. The electrostatic latent image is developed at development station 40 which may comprise a rotatable roll 42 with, for example, a single component developer. The developer roll may also alternatively be used to clean the photoconductor of any residual developer on its return path to the supply roll as will be described in more detail later. Following development the photoreceptor web with the discharged toner image is transported past self stripping roll 44 (described later) toward photoreceptor take up roll 14 with the lead edge of a sheet of copy paper being positioned to enter the nip of the take up roll 14 in registration with the lead edge of the image of the document on the photoconductive web. This may be accomplished, for example, by inserting a copy sheet in copy sheet entrance slot 48 which is driven by resilient foam drive roll 50 in contact with the take up roll 14. The copy sheet is maintained in contact with the take up drum through the action of idler rolls 56 and is wound in contact with the photoconductor around the take up roll to form a transfer sandwich which will be described in greater detail hereinafter. The photoconductive web with the developed toner image side in contact with the copy sheet is wound up on the take up roll until the end of the image area of the photoconductive web has been contacted with the end of the copy sheet. An arcuate sandwich of photoconductive web, toner and copy sheet is thereby formed around a portion of the take up roll 14 it being noted that the circumference of the take up roll is greater than the length of the photoconductive imaging strip area 10 or the length of the copy sheet. Basically the take up roll comprises a conductive electrode and the leader of the photoconductor web is a dielectric material so that the sandwich formed on the take up roll comprises sequentially a grounded conductive photoconductor backing, charged and exposed photoconductor bearing an electrostatic latent image, the developed toner image, the copy paper, the dielectric and the conductive take up roll. After the sandwich is formed in the nip area, the translucent conductive backing of the photoconductor is exposed by lamp 52 placed just beyond the sandwich nip entrance with the light which passes through discharging the electrostatic latent image on the photoconductor.

After the sandwich has been formed a potential is applied to the conductive take up roll to form an electric field to drive the toner from the photoconductor to the copy sheet in image configuration. For example, if the photoconductor is negatively charged to a potential 600 to 700 volts, exposed to the document to be reproduced and developed with positively charge toner particles a negative bias on the conductive take up roll of 1400 to 1700 volts will create a strong field to drive the toner to the copy paper.

Once the entire image area of the photoconductive web has been taken up on the conductive take up roll in the transfer sandwich, the direction of the photoconductor web is reversed and the photoconductor is rewound on the supply roll. This may be readily accomplished by merely activating a microswitch at the end of the imaging path on the photoconductor which reverses the drive on the supply roll with the spring 31 in the take up roll insuring tension in the web regardless of take up roll diameter. A second microswitch is actuated on rewinding the supply roll which shuts the machine down. The bias on the conductive take up roll is maintained and the discharge lamps remain activated during the rewind cycle as the copy sheet is separated from the dielectric layer. When the rewinding sandwich (photoconductive layer and copy sheet) reach the self stripping roller 44, the photoconductive layer continues to rewind on the supply roll 18 as the copy sheet self strips around the self stripping roller 44 and carries on into the toner image fixing device illustrated here as a pressure roll fuser 53. Following fixing of the toner image on the copy sheet, the copy sheet is driven out of the copy exit chute 54. As the photoconductor is rewound, it passes by the developer roll which may be used to scavenge residual toner remaining on the photoconductor following development. Alternately, a cleaning blade 55 may be used to clean the residual toner from the photoconductor. Both of these cleaning techniques lend themselves to reclaiming toner and using it again. It should be noted that if a cleaning blade is used that it is preferred to positively drive the supply roll to insure that sufficient torque is available to pull the web past the cleaning blade.

With this configuration one need only insert the document in the document entrance chute 24, the copy sheet in the copy sheet entrance 48, press the "START PRINT" button to make a copy. The machine drives are activated, they drive the copy sheet between the driven foam drive roll and the photoconductor web take up roll while simultaneously the document is driven past the imaging platen, the photoconductor supply roll is driven forward as well as the charging brush being activated. When the photoconductor web has been taken up on the take up roll, the direction is reversed with the leading edge of the photoconductor being rewound up to the supply roll and the copy sheet exiting the machine. It should be noted that once the original document has been driven past the imaging platen on a scanning slit it is fed out the output document chute 29.

Figure 1:
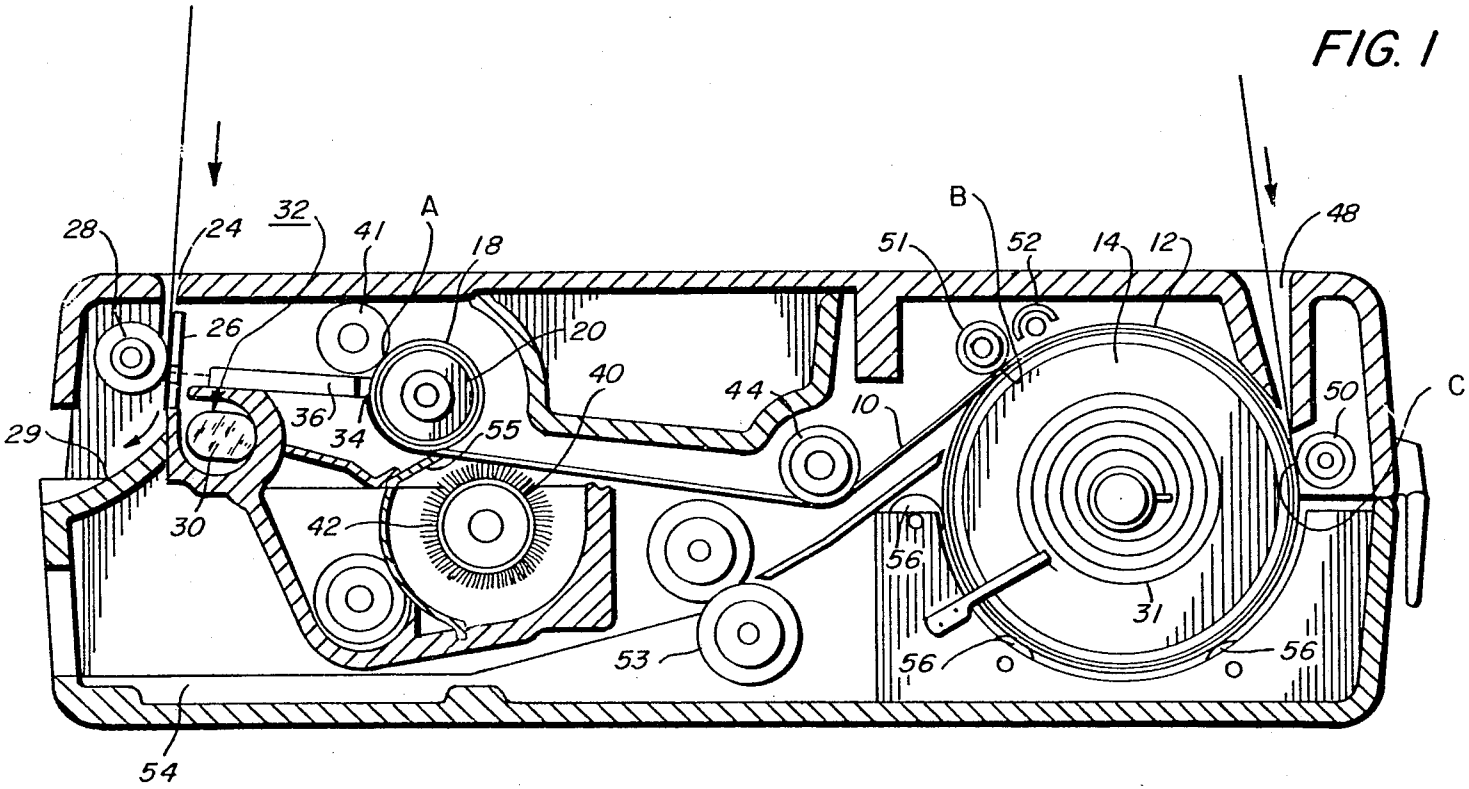
FIG. 1 is a schematic view in cross-section of an electrostatographic apparatus in which the present invention may be implemented.

As will be appreciated from FIG. 1, the illustrated design is based in part on a geometric relationship between the distance the copy paper travels and the distance the photoconductor travels. In particular, the distance from the copy paper entrance, the nip C between the feed roll 50 and the conductive take up roll 14 around the conductive roll to the contact point B where the roll 51 holds the photoconductive web in contact with the take up roll 14 and where the lead edge of the developed image on the photoconductor contacts the lead edge of the copy sheet is equal to the distance from the photoconductor charging station here illustrated as charging brush 41 and contact point A with the imaging layer 12 to the contact point of the lead edge of the developed image on the photoconductor with the lead edge of the copy sheet. As illustrated in FIG. 1, the distance AB along the photoconductive path is equal to the distance BC along the circumferential take up roll path. This geometric configuration provides a unique superior extremely uncomplicated design which in addition to its simplicity is extremely low in cost in that the conventional registration rolls, clutches, fingers, timing circuits, etc., are not required. With continued reference to FIG. 1, it will be observed that the insulating leader strips 12 and 18 are at least as long as the distance AB.

FIG. 2 schematically illustrates in exaggerated cross-section, the transfer sandwich which is formed according to the technique of the present invention. The photoconductive insulating layer 62 supported on a conductive backing 60 which will bear an electrostatic latent image may be charged negatively, for example, to about 600 volts followed by imagewise exposure and development by positively charged toner particles 64 in a development zone. As illustrated this imaging layer is wrapped around the transfer roller with the lead edge of the copy paper 66 being brought into contact with the lead edge of the image on the imaging layer. The transfer roller comprises a dielectric layer 68 on top of, for example, an aluminum coated cyclindrical roll 70. The circumference of the cylindrical roll is sufficient to accommodate the entire length of the copy sheet and the image area of the photoconductor to insure the necessary electrostatic cooperation to be described hereinafter.

As mentioned previously, the sandwich is formed by wrapping the photoconductive insulating layer bearing the toner image in contact with a copy substrate and the dielectric layer around the conductive coated roll in the absence of any applied electric field. Once the transfer sandwich has been formed a transfer field may be applied between the ground plane (the conductive backing) of the photoconductor and the conductive roll in such a way as to drive the toner from the photoconductive insulating layer onto the copy paper. During this transfer operation pressure is maintained low in order to insure the absence of hollow character generation and image disturbance by excessive pressure. However, during the formation of the transfer sandwich it should be understood that sufficient pressure is applied to remove air from the gap as the copy paper and photoreceptor are wound around the transfer roll. This pressure is sufficient to provide good contact to delete the air so that upon the application of an electric field across the various members, no air breakdown or field reduction due to spacing will occur. During the wrapping operation the conductive back of the photoconductive layer which may be transparent but is at least translucent is exposed to light by lamp 52 after the incoming nip where the sandwich is formed to discharge the electrostatic latent image on the photoconductor.

Once the transfer sandwich has been formed a negative potential of, for example, 1400 to 1700 volts DC may be applied to the aluminum coating on the roll to thereby create the necessary electric field between the ground plane of the photoconductor and the coated roll to thereby create the strong field which drives the toner from the photoconductor surface to the copy paper. Following application of this field and while the field is still being applied, the sandwich may be separated to provide a copy substrate having the toner on it in image configuration. As the sandwich is separated by being unwrapped, for example, the dielectric layer may be first separated from the copy substrate and the electric field goes to zero since the plate of the capacitor formed by the transfer sandwich are physically separated. Since the toner has already been attracted to the copy paper, the copy paper can be readily separated from the photoconductive layer. As a result of the exposure of the conductive backing on the photoconductor the image potential holding the toner material on the photoconductor is very low. It should be explained that following formation of the transfer sandwich the image charge on the insulating layer is removed in any suitable way. As illustrated, typically the photoconductor material is backed by a translucent conductive substrate so that upon illumination with radiation the charge in image configuration is dissipated by the photoconductive material being rendered conductive upon exposure to the radiation. In this regard it is necessary only in this configuration that the backing of the photoconductive layer be sufficiently translucent to let enough light in to discharge the photoconductor layer.

While the invention has up to this point been described with particular reference to a photoconductive insulating material as the imaging layer it should be noted that the imaging layer may comprise any insulating layer upon which an electrostatic latent image may be formed. If such a layer is insulating and not photoconductive means other than the lamp 52 must be used to discharge the electrostatic latent image after the sandwich is formed and before it is separated.

Any suitable photoconductive layer may be used in the practice of the present invention. Particularly preferred type of composite material used in xerography is illustrated in the U.S. Pat. No. 4,265,990 the disclosure of which is hereby totally incorporated in its entirety. The photoconductive layer described in the above noted patent illustrates a photosensitive member having at least two electrically operative layers, one layer comprises a photoconductive layer which is capable of photogenerating holes and injecting photogenerated holes into a contiguous charge transport layer. Typically this comprises a polycarbonate resin containing from about 25–75% by weight of one or more of certain substituted diphenyldiamine compounds. Various generating layers comprising photoconductive layers exhibiting the capability of photogeneration of holes and injection of the holes into the charge transport layer have also been investigated. Typical photoconductive materials utilized in the generating layer included amorphous selenium, trigonal selenium, and selenium alloys such as selenium tellurium, tellurium arsenic, selenium arsenic and mixtures thereof. This photoconductive layer is typically coated on a conductive substrate which may, for example, be a very thin layer of aluminum oxide which is electrically connected to ground. As previously noted the conductive substrate is translucent or transparent to light to enable discharge of the charged pattern in the photoconductive layer at the appropriate time during the transfer operation.

As previously illustrated, the photoconductor insulating layer can be charged and exposed and the image developed with charged toner particles in conventional manner. During the development of the electrostatic latent image on the photoconductor it should be noted that charged toner particles which are charged to a polarity opposite the polarity of charge on the photoconductive insulating layer partially neutralize the charge in image configuration to bring it down to a level of the order of around −100 to −200 volts. Following formation of the developed image the photoconductive layer is brought into contact with the copy paper in the absence of an electric field and as illustrated, wrapped around a dielectric coated conductive roll. It should be noted that while the transfer sandwich as illustrated is a cyclindrical roll it must be appreciated that other types of transfer sandwiches may be formed. For example, the sandwich may be formed in a planar configuration merely by passing the developed photoconductor layer and copy paper between the same type of sandwich supporting members.

The dielectric layer in the transfer sandwich which may be the leader for the photoconductive layer forms a blocking electrode thereby preventing air breakdown by way of prohibiting the current from flowing through the photoreceptor to the conductive roll and thereby prevents field collapse. It maintains the field as high as possible insuring good transfer. Any suitable dielectric layer may be used for this purpose. A typical material is Mylar which is a polyethylene terephthalate available from E. I. DuPont and Company. During the formation of the sandwich, the copy paper is inserted between the photoreceptor and the dielectric layer. In addition, in order to maximize the electric field during the transfer operation the thinner the paper the greater is the transfer efficiency in the transfer operation. It should be noted in this connection that the transfer efficiency goes up with the strength of the field and reaches a plateau. Thus in regulating the transfer sandwich when the bias is applied it is best to apply the bias so that it will be capable of handling papers of all thickness.

After the transfer sandwich has been formed, the image charge on the photoconductive layer may be discharged in any suitable manner. Typically with the configuration illustrated in the present embodiment this is done by exposure of the back of the photoconductor to light. This enables the potential on the photoreceptor to be discharged thereby permitting the toner to be more readily attracted to the copy paper in response to the field when the field is applied to the conductive electrode.

A field can be applied to the conductive electrode either before, concurrently or after discharge. The important factor being that you do not separate the sandwich, i.e., do not unwind the transfer member without first having discharged the photoreceptor. Following discharge of the charged image on the photoconductive insulating layer a potential may be applied to the conductive aluminum coated roll to create a field to drive the toner from the photoreceptor to the copy paper. Typically this is of the order of negative 1400 to 1700 volts, thereby creating a strong field which drives the toner from the photoconductor to the copy paper.

During the formation of the transfer sandwich and in particular the wrapping of the paper, photoreceptor and the dielectric layer together it is important to not provide any wrong sign or in the present case plus charging function to the copy paper or the dielectric layer since such will thereby tend to reduce the transfer field. This may be insured by providing a conductive brush on the back of the sandwich roll to leak away any wrong sign charge that may be generated between the copy paper and the Mylar.

With the illustrated transfer method and apparatus we have found that the transfer efficiency, which is the fraction of the developed mass of toner which is transferred to paper compared to the total mass of toner on the photoconductive layer, to be typically of the order of 85%–90% which compares very, very favorably and indeed exceeds many of the prior art techniques which could only achieve a maximum transfer efficiency of around 80%–85% under ideal conditions.

As may be appreciated from reference to the foregoing specification the transfer method and apparatus of the present invention provides a technique for the very efficient reliable transfer of a toner in image configuration from an imaging surface, such as a photoconductive insulating layer to a copy substrate. In particular the method and apparatus of the present invention overcome many of the difficulties associated with prior art techniques of transferring toner images in such configurations. Since the technique according to the present invention does not involve ionization species, it is less humidity sensitive, and therefore less sensitive to swings in humidity or moisture content of the paper since no field is applied until a transfer sandwich is formed. Moreover during the formation of the sandwich or during the bringing together of the insulating imaging surface bearing the toner image which is to be transferred to the copy sheet, no transfer field is applied between the insulating imaging surface and the copy sheet. Accordingly, the toner image on a photoconductive insulating layer, for example, is not subject to being displaced or in any way altered. As a result of this configuration, there is an electrostatic field free entrance of the copy sheet and a greatly improved transfer efficiency of toner from the insulating surface to the copy sheet. This is in distinct contrast to the bias roll transfer device. The present invention allows one to form the transfer sandwich with no applied field, thereby avoiding high field conditions after the paper is in intimate contact with the image. This is also to be distinguished from bias roll transfer which provides a relatively high field condition at the beginning or entrance of the copy sheet through the transfer nip so that it is possible to provide air breakdown resulting in poor transfer and toner image explosions. In addition, the low voltage transfer operation of the present invention permits one to reclaim and reuse any residual toner left on the photoconductor since the toner is not charged to the opposite polarity by a transfer corotron as in corona transfer. And finally, the simplicity of the apparatus readily lends itself to low cost manufacture and usage.

While the above invention has been described with reference to specific embodiments, it will be apparent to those skilled in the art that many alternatives, modifications and variations may be made. For example, while the invention has been illustrated with particular reference to the formation of a sandwich around a conductive roll having a dielectric layer coated thereon, it should be noted that a planar sandwich is equally effective in performing the necessary functions. It is intended that this embodiment as well as other alternatives, modifications and variations are embraced within the spirit and scope of the appended claims.

What is claimed is:

1. Apparatus for transferring charged toner present in image configuration on an insulating layer bearing an electrostatic latent image to a copy substrate, said apparatus comprising an insulating layer on an electrically grounded conductive substrate, means to form a sandwich comprising in sequential order said conductive substrate support for said insulating layer, said insulating layer bearing said electrostatic latent image, the toner image, copy substrate, dielectric layer, and conductive electrode; means for applying a potential to said conductive electrode after said sandwich is formed of a magnitude and potential sufficient to create an electric field to transfer toner from the insulating layer to the copy substrate, means to discharge the electrostatic latent image on said insulating layer before separation of said sandwich, and means to strip said copy substrate from said dielectric layer while said field is applied.

2. The apparatus for transferring toner of claim 1, including means to separate said copy substrate from said insulating layer to provide a transferred toner image on said copy substrate.

3. The apparatus for transferring toner of claim 1, wherein said insulating layer is a photoconductive insulating layer coated on a translucent conductive substrate.

4. The apparatus for transferring toner of claim 1, wherein said discharge means includes means to discharge before and/or concurrently with application of the potential to said conductive electrode and before separation of the sandwich.

5. The apparatus for transferring toner of claim 1, including means to form said sandwich with substantially no electric field tending to drive the toner image from the insulating layer to the copy substrate.

6. The apparatus for transferring toner of claim 3, including exposure means to discharge said image pattern on said photoconductive insulating layer of said conductive substrate by exposure to light.

7. The apparatus for transferring toner of claim 2, wherein said dielectric layer and conductive electrode comprise a conductive roll as the electrode, the surface of which is coated with a dielectric blocking electrode thereby permitting the sandwich to be formed by wrapping the insulating layer with the toner image in contact with a copy substrate around the roll with the dielectric blocking electrode in between the insulating layer and the conductive electrode.

8. The apparatus for transferring toner of claim 7, wherein said roll is an aluminum coated roll and said dielectric is a polyethylene terephthalate film.

9. The apparatus for transferring toner of claim 7, wherein the circumference of the roll is at least equal to the length of the image on the insulating layer and the copy sheet and including means to unwrap the sandwich after it is completely formed and while potential is applied to said conductive electrode.

10. The apparatus for transferring toner of claim 7, wherein said insulating layer comprises a photoconductive insulating layer coated on a translucent conductive substrate and including exposure means to discharge said image pattern in said photoconductive insulating layer of said conductive substrate by exposure to light.

11. The apparatus for transferring toner of claim 10, wherein said exposure means is positioned at the nip where the lead edge of the sandwich is formed and said exposure means is energized during both the wrap up and unwrap steps.

12. The apparatus for transferring toner according to claim 1, including means to form the sandwich without charging the copy substrate or the dielectric layer.

13. The apparatus for transferring toner according to claim 1, wherein said means for forming a sandwich applies only sufficient pressure between the insulating layer and the copy substrate to provide intimate contact therebetween and is at a level below which by itself produces little pressure transfer of toner from the insulating layer to the copy substrate.

14. A method for transferring charged toner present in image configuration on an insulating layer bearing an electrostatic latent image said insulating layer being supported by an electrically grounded conductive substrate, to a copy substrate comprising forming a sandwich comprising in sequential order, the conductive substrate, insulating layer, toner image, copy substrate, dielectic layer and conductive electrode, applying a potential to said conductive electrode of a magnitude and potential sufficient to create an electric field to transfer toner from the insulating layer to the copy substrate, discharging the electrostatic latent image on said insulating layer at least before separation of said sandwich and stripping said copy substrate from said dielectric layer while said field is applied.

15. The method of claim 14, including the step of separating said copy substrate from said insulating layer to provide a transferred toner image on said copy substrate.

16. The method of claim 14, wherein said insulating layer is a photoconductive insulating layer coated on a translucent conductive substrate.

17. The method of claim 14, wherein the charged pattern on said insulating layer is discharged before and/or concurrently with application of the potential to the conductive electrode and before separation of the sandwich.

18. The method of claim 14, wherein said sandwich is formed with substantially no electric field tending to drive the toner image from the insulating layer to the copy substrate.

19. The method of claim 16, wherein said conductive substrate is translucent and said image pattern on said photoconductive insulating layer is discharged by exposing the translucent conductive substrate to light.

20. The method of claim 14, wherein said sandwich is formed by wrapping the insulating layer with the toner in contact with a copy substrate around a cyclindrical conductive roll electrode with a dielectric blocking electrode being placed between the insulating layer and the conductive electrode.

21. The method of claim 20, wherein said roll is an aluminum coated roll and said dielectric is a polyester terephthalate film.

22. The method of claim 21, wherein the circumference of said roll is at least equal to the length of the image on the insulating layer and the copy sheet and including the step of unwrapping the sandwich after it has been completely formed and while a potential is applied to the conductive electrode.

23. The method of claim 22, wherein said insulating layer comprises a photoconductive insulating layer coated on a translucent conductive substrate and including the step of exposing the conductive substrate to light, to discharge the electrostatic latent image after the sandwich has been formed.

24. The method of claim 23, wherein said translucent conductive substrate is exposed at the wrap up nip after the sandwich has been formed during both the wrap up and unwrap steps.

25. The method of claim 14, wherein the sandwich is formed without charging the copy substrate or the dielectric layer.

26. The method of claim 14, wherein said sandwich is formed with only sufficient pressure between the insulating layer and the copy substrate to provide intimate contact therebetween and is at a level below which by itself it provides little pressure transfer of toner from the insulating layer to the copy paper.

27. The method of claim 14, wherein said blocking electrode prevents air breakdown by maintaining the electric field and not permitting conduction of electric current from the insulating layer to the conductive electrode.

* * * * *